United States Patent [19]

Asano

[11] 4,084,344

[45] Apr. 18, 1978

[54] TOY CONSTRUCTION SET

[75] Inventor: Kiyoji Asano, Tokyo, Japan

[73] Assignee: Shinsei Kogyo Co., Ltd., Tokyo, Japan

[21] Appl. No.: 666,440

[22] Filed: Mar. 25, 1976

[51] Int. Cl.[2] ..... A63H 33/00

[52] U.S. Cl. ..... 46/28

[58] Field of Search ..... 46/29, 28, 19

[56] References Cited

U.S. PATENT DOCUMENTS

| | | | |
|---|---|---|---|
| 1,400,066 | 12/1921 | Huck | 46/29 |
| 1,973,536 | 9/1934 | Mack | 46/29 |
| 3,890,738 | 6/1975 | Bassani | 46/29 X |

*Primary Examiner*—F. Barry Shay

*Attorney, Agent, or Firm*—Staas & Halsey

[57] ABSTRACT

A toy construction set consisting of a plurality of corner posts each having a leg, first and second groups of two arms each extending outwardly from the leg, and a locking cavity formed within the end of each arm; a plurality of middle posts each having a leg, first and second groups of three arms each extending outwardly from the leg, and a locking cavity formed within the end of each arm; at least one corner post having a leg, first and second groups of four arms each extending outwardly from the leg, and a locking cavity formed within the end of each arm; a plurality of beams each terminating in locking projections complimentary in configuration with respect to the locking cavities of the arms.

1 Claim, 10 Drawing Figures

TOY CONSTRUCTION SET

BACKGROUND AND SUMMARY OF THE INVENTION:

The present invention relates to a toy construction set featuring a plurality of distinct building elements which may be interrelated in different configurations so as to permit the child to design and construct a variety of structures. More particularly, there are disclosed separate embodiments of corner, middle and center posts, each of varying arm configurations and each featuring locking mechanisms of durable simplified construction permitting the posts to be interchangeably connected by beams.

Figure 1:
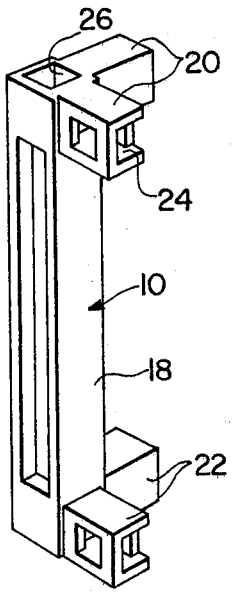
FIG. 1 is a perspective view of one embodiment of the corner post of the present invention.
Figure 2:
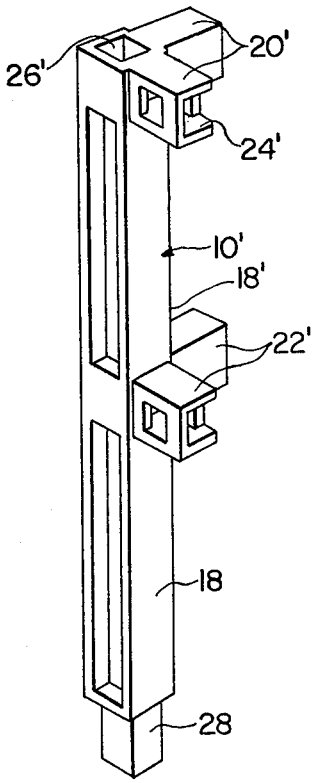
FIG. 2 is a perspective view of a second embodiment of the corner post.
Figure 3:
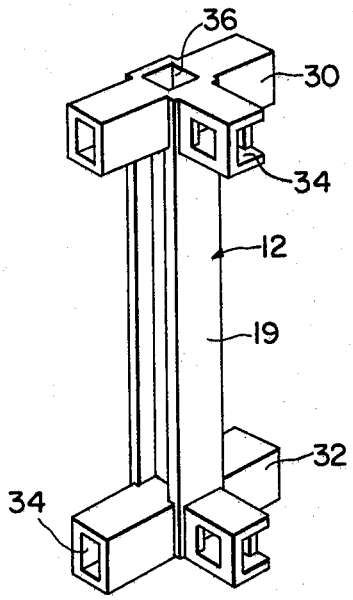
FIG. 3 is a perspective view of a first embodiment of the middle post.
Figure 4:
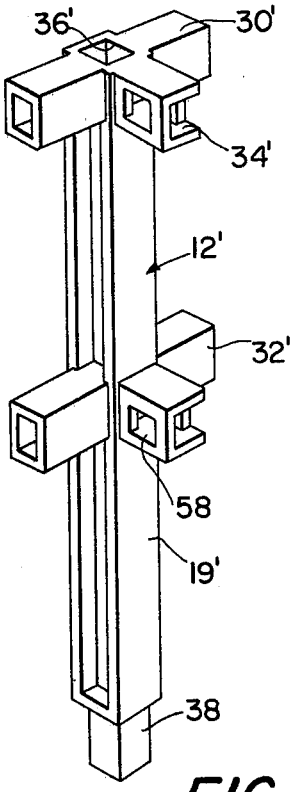
FIG. 4 is a perspective view of a second embodiment of the middle post.
Figure 5:
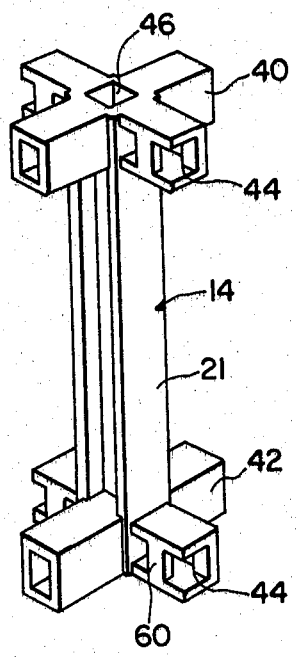
FIG. 5 is a perspective view of a first embodiment of the center post.
Figure 6:
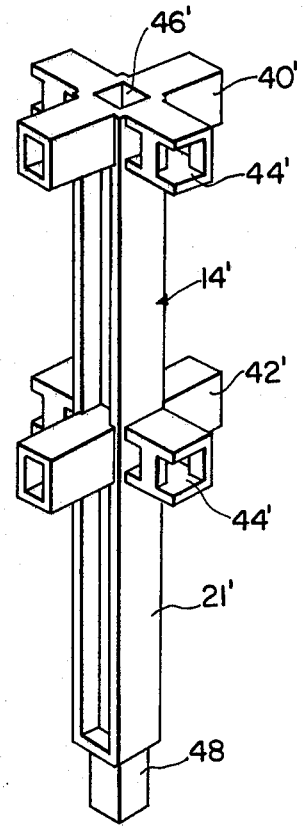
FIG. 6 is a perspective view of the second embodiment of the center post.
Figure 7:
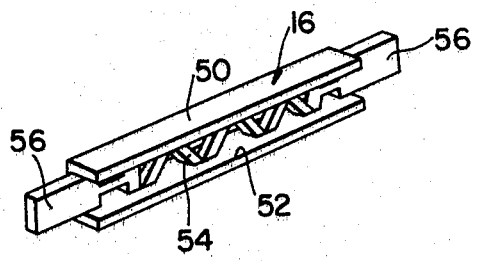
FIG. 7 is a perspective view of one of the beams of the present invention.

DESCRIPTION OF THE PREFERRED EMBODIMENT:

The toy construction set of the present invention consists of corner posts designated by the reference numerals 10 and 10' in FIGS. 1–2, middle posts 12 and 12' as illustrated in FIGS. 3–4, center posts 14 and 14' as illustrated in FIGS. 5–6, and beams designated by the reference numeral 16 in FIG. 7. It will be apparent from FIG. 8 that the aforementioned posts and beams may be assembled by the child in virtually an endless variety of different configurations.

Returning to FIG. 1, it will be apparent that the first embodiment 10 of the corner post consists of a leg 18 that is provided at one end thereof with first arms 20 and at the opposite end thereof with second arms 22. The arms 20 and 22 extend outwardly at approximately 90 degrees from the leg 18 and adjacent of the arms 20 and 22 define an angle of approximately 90 degrees therebetween. Within the end of each of the arms 20 and 22 there is provided a locking cavity 24, to be explained in detail hereinafter. In similar manner, there is provided a locking cavity 26 within the top of the leg 18 adjacent the outwardly extending arm 20.

The second embodiment 10' of the corner posts is illustrated in FIG. 2 wherein it will be apparent that the leg 18' is provided at the top thereof with outstanding arms 20' which are identical in configuration with the arms 20 of the first embodiment 10, as illustrated in FIG. 1. In similar manner, there are provided outwardly extending arms 22' located near the midportion of leg 18'. A locking projection 28 is located at the lower end of the leg 18', and is of a dimension and configuration to permit insertion within the locking cavities 26 and 26'.

The first embodiment 12 of the middle post is illustrated in FIG. 3 wherein it will be apparent that the leg 19 is provided with two groups of three outstanding arms 30 and 32. Two of each group of the arms 30 and 32 are positioned in a straight line so as to define a wall while the third arm of each group extends outwardly at approximately 90 degrees therefrom. In the same manner as previously described with respect to the corner posts 10 and 10', each arm 30 and 32 of the middle posts 12 and 12' is provided with locking cavities 34 and 34'.

The second embodiment 12' of the middle post is illustrated in FIG. 4 wherein it will be apparent that the leg 19' is provided at the bottom thereof with a locking projection 38 identical in configuration to the locking projection 28 shown in FIG. 2.

The first embodiment 14 of the center post is illustrated in FIG. 5 wherein it will be apparent that the leg 21 is provided with four equally spaced, outwardly extending arms 40 and 42, adjacent of which are spaced apart by approximately 90°. At the bottom of the leg 21 there are provided similarly spaced legs 42. Each of the legs 40 and 42 is provided with a locking cavity 44 identical to those previously described with respect to the corner and middle posts, while the top of the leg 21 is provided with a locking cavity 46.

The second embodiment 14' of the center post is illustrated in FIG. 6 and includes a leg 21' provided with groups of outwardly extending arms 40' and 42', each of which is provided with a locking cavity 44'. The top of the leg 21' is provided with a locking cavity 46' while the bottom thereof is provided with a locking projection 48 that is identical to projections 28 and 38 as previously described.

Each of the beams 16, as illustrated in FIG. 7, consists of spaced flanges 50 and 52 connected with ribbing 54 which terminates at each end thereof in outwardly extending locking projections 56 which are complimentary in configuration with respect to the locking cavities 24, 24', 34, 34', 44 and 44'.

It will be apparent that certain of the arms 20, 30 and 40 of the corner, middle and center posts 10, 12 and 14, respectively, are provided with solid walls defining the cavity within which the locking projections 56 of the beams 16 pass whereas other of the arms are provided with non-solid wall structures. With respect to the later, it can be seen from FIGS. 4 and 5, for example, that certain of the arms are provided with an opening 58 spanning substantially the entire length of the arm, whereas the other side thereof is provided with a centrally disposed supporting rib 60, it being understood that the locking projections 56 of the beams 16 pass between the openings 58 and the ribs 60.

The corner, middle and center posts 10, 10', 12, 12', 14 and 14', respectively, and the beams 16 are constructed of stiff, resilient plastic and are ideally suited for molding.

Figure 8:
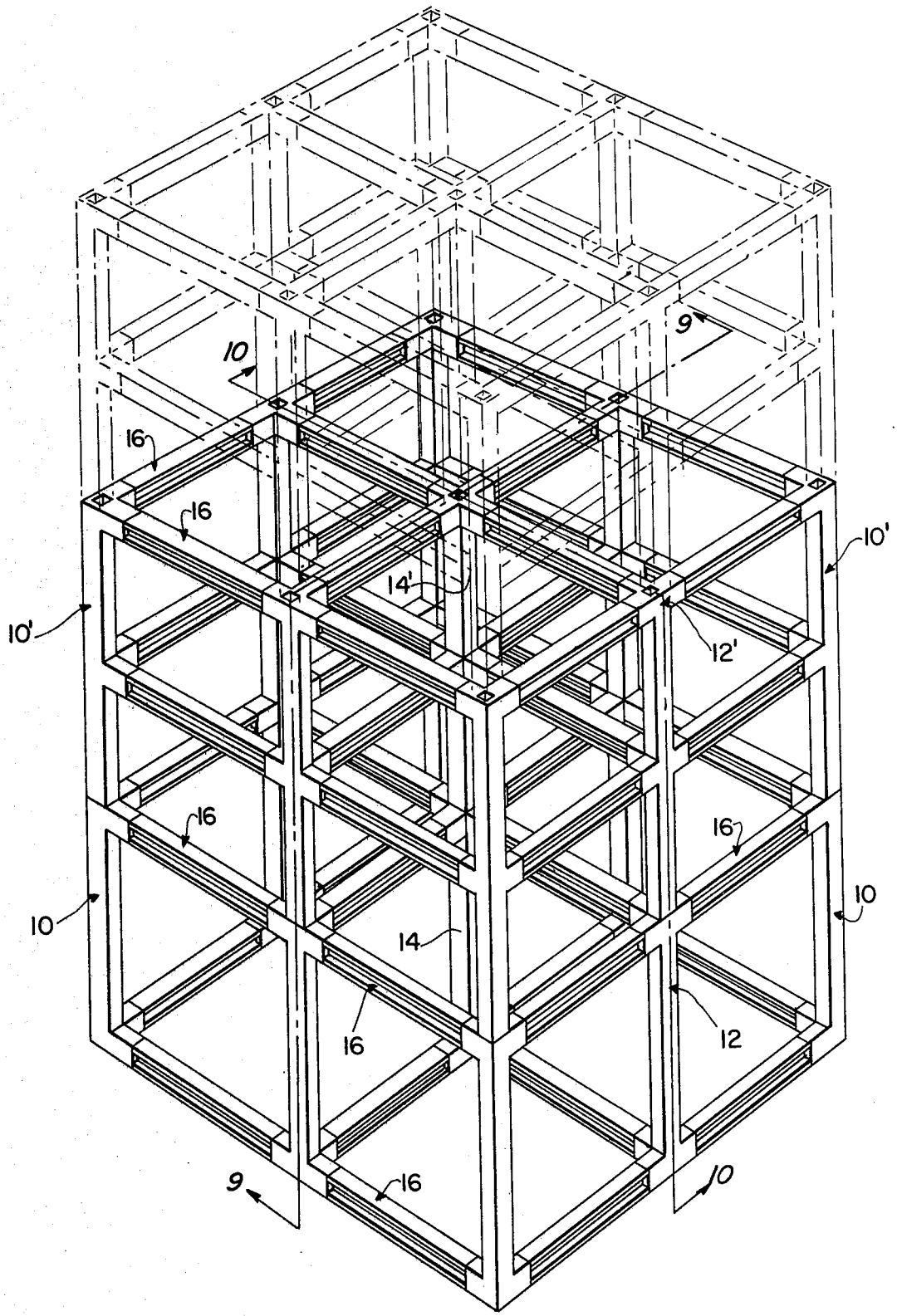
FIG. 8 is a perspective view of one of many possible assemblies of the corner, middle and center posts and interconnecting beams for the purpose of illustrating how the above-noted structural elements may be assembled.
Figure 10:
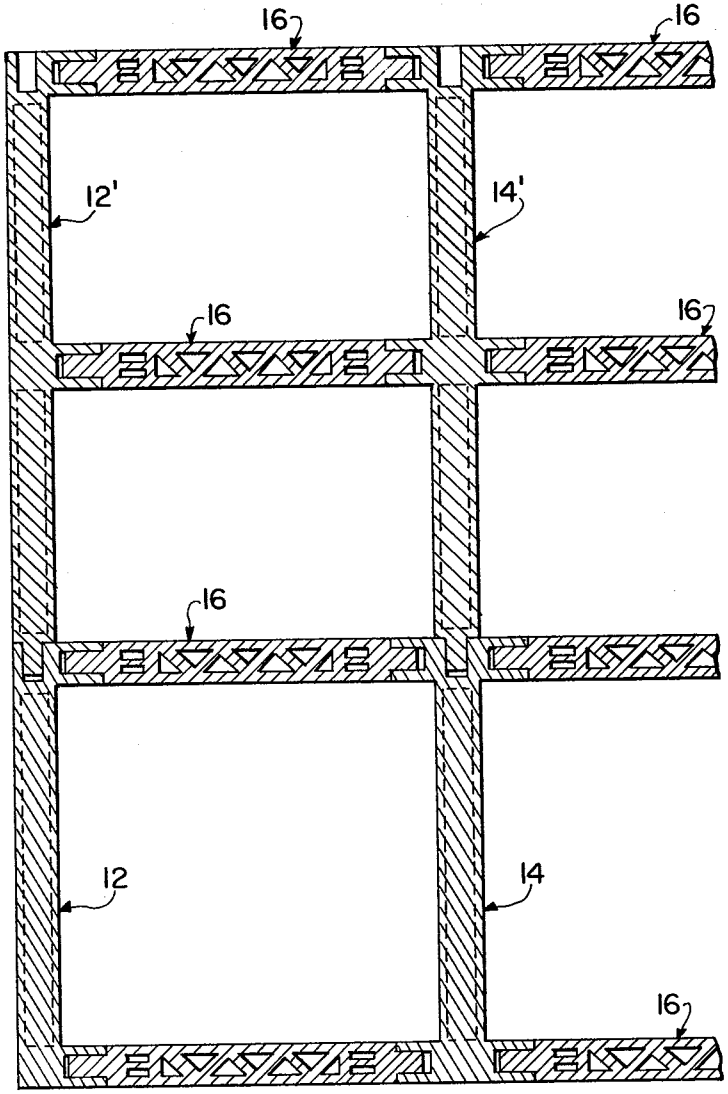
FIG. 10 is a cross-sectional view taken along line 10–10 of FIG. 8.
Figure 9:
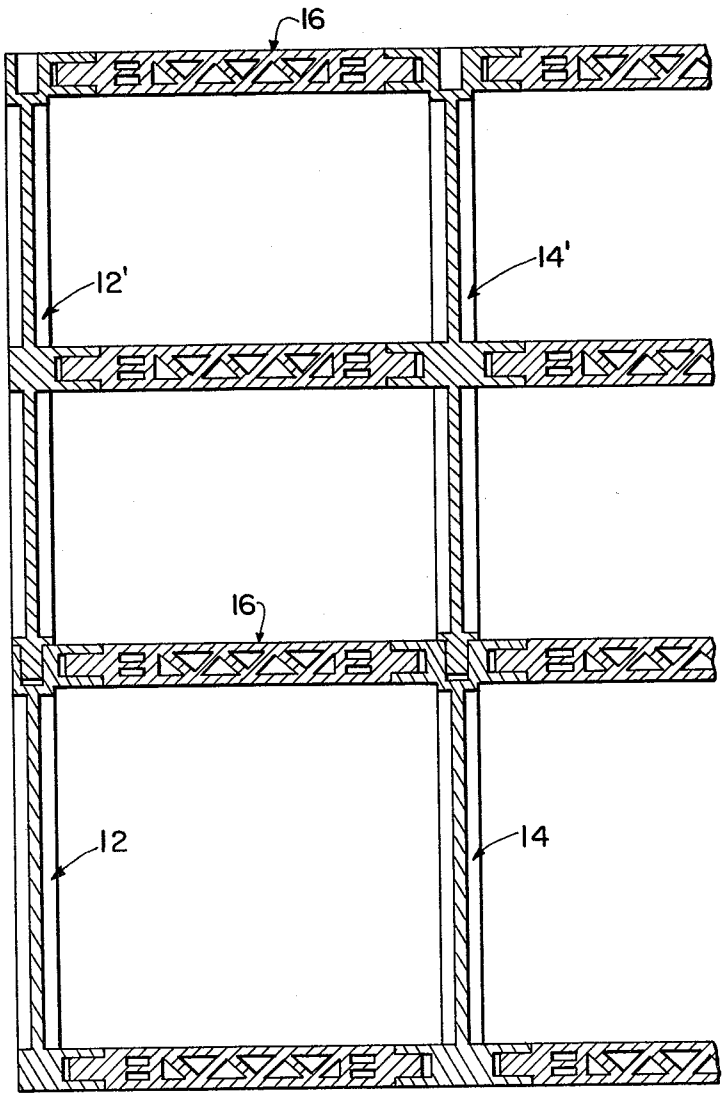
FIG. 9 is a cross-sectional view taken along line 9–9 of FIG. 8.

It will be apparent from FIGS. 8-10 that the corner posts 10 and 10', middle posts 12 and 12', center posts 14 and 14' and beams 16 may be assembled in virtually an endless variety of configurations. The first embodiment corner post 10, first embodiment middle post 12 and first embodiment center post 14 are designed to rest upon a flat surface whereas the second embodiment corner post 10', second embodiment middle post 12' and second embodiment center post 14' are designed to permit the child to build upwardly from the corresponding first embodiments.

I claim:

1. A toy construction set, comprising:

a plurality of one-piece corner posts comprising:

a first group each comprising a leg, first and second groups of two arms each extending outwardly from the ends of said leg, a locking cavity formed within the end of each of said arms, and a locking cavity formed within one end of said leg; and a second group each comprising a leg, first and second groups of two arms each extending outwardly from an end and midportion of said leg, respectively, a locking cavity formed within the end of each of said arms, a locking cavity formed within said end of said leg, and a locking projection formed at the other end of said leg;

a plurality of one-piece middle post comprising:

a first group each comprising a leg, first and second groups of three arms each extending outwardly from the ends of said leg, a locking cavity formed within the end of each of said arms, and a locking cavity formed within one end of said leg;

a second group each comprising a leg, first and second groups of three arms each extending outwardly from an end and midportion of said leg, respectively, a locking cavity formed within the end of each of said arms, a locking cavity formed within said end of said leg, and a locking projection formed at the other end of said leg;

a plurality of one-piece center posts comprising:

a first group each comprising a leg, first and second groups of four arms each extending outwardly from the end of said leg, a locking cavity formed within the end of each of said arms, and a locking cavity formed within one end of said leg;

a second group each comprising a leg, first and second groups of four arms each extending outwardly from an end and midportion of said leg, respectively, a locking cavity formed within the end of each of said arms, a locking cavity formed within said end of said leg, and a locking projection formed at the other end of said leg;

a plurality of one-piece beams terminating at each end thereof in locking projections;

said locking projections of said second group of said corner, middle and center posts, respectively, being complimentary in configuration with respect to said locking cavities of said legs of said first and second groups of said corner, middle and center posts, respectively; and said locking projections of said beams being complimentary in configuration with respect to said locking cavities of said arms of said first and second groups of said corner, middle, and center posts, respectively;

said legs of said first and second groups of said corner, middle, and center posts being of uniform cross-sectional area between the respective groups of arms, and wherein said locking cavities of said legs of said first and second groups of said corner, middle and center posts are square in cross-section and wherein said locking projections of said second group of said corner, middle and center posts are square in cross-section enabling same to be fitted within said locking cavities of said legs of said first and second groups of said corner, middle and center posts;

said arms of said first and second groups of said corner, middle and center posts being rectangular in cross-section and of the same dimension, and wherein said locking cavities of said arms of said first and second groups of said corner, middle and center posts are rectangular in cross-section and said locking projections of said beams are rectangular in cross-section enabling same to be fitted within said locking cavities of said arms;

wherein certain of said locking cavities formed within the ends of said arms of said first and second groups of said corner, middle and center posts each comprise a first wall provided with an opening therein, a second wall spaced from said first wall and positioned opposite said opening in said first wall, and top and bottom walls connecting said first and second walls.

* * * * *